United States Patent [19]

Budzich et al.

[11] 4,327,617

[45] May 4, 1982

[54] COIL REMOVAL APPARATUS

[75] Inventors: Mieczyslaw Budzich; Forest G. Fitz, Jr., both of Lexington, S.C.

[73] Assignee: Nassau Recycle Corporation, Staten Island, N.Y.

[21] Appl. No.: 116,728

[22] Filed: Jan. 30, 1980

[51] Int. Cl.[3] ..... B26D 5/04; B26D 7/01

[52] U.S. Cl. ..... 83/419; 83/519; 83/639; 83/640; 83/924; 83/928; 28/295; 242/48

[58] Field of Search ..... 28/295; 242/48; 414/795, 908, 910; 83/519, 550, 622, 636, 639, 640, 909, 919, 924, 928, 213, 214, 513, 907, 419

[56] References Cited

U.S. PATENT DOCUMENTS

| | | | |
|---|---|---|---|
| 369,344 | 9/1887 | Kohler | 83/519 |
| 607,165 | 7/1898 | Freese | 83/519 |
| 1,951,088 | 3/1934 | Freeley et al. | 414/908 |
| 2,663,926 | 12/1953 | Ewing | 28/295 |
| 2,760,570 | 8/1956 | Reckhow | 28/295 |
| 2,866,504 | 12/1958 | Syers | 83/919 |
| 2,957,065 | 10/1960 | Bundegaard | 28/295 |
| 3,449,993 | 6/1969 | Temple | 83/519 |
| 3,464,298 | 9/1969 | Roach | 83/640 |
| 3,688,818 | 9/1972 | Domres | 83/419 |
| 4,273,738 | 6/1981 | Spengler | 83/639 |

FOREIGN PATENT DOCUMENTS

| | | | |
|---|---|---|---|
| 344610 | 11/1921 | Fed. Rep. of Germany | 83/622 |
| 1197588 | 12/1959 | France | 83/639 |

*Primary Examiner*—Stephen G. Kunin
*Assistant Examiner*—K. Bradford Adolphson
*Attorney, Agent, or Firm*—Robert B. Kennedy

[57] ABSTRACT

Apparatus is provided for removing coils of scrap wire or cable (103) from about a reel (100) comprised of an array of juxtaposed cutting blades (50–53) and apparatus (60–63, 54–57) for reciprocally driving each of the blades independently along a different path in a group of mutually juxtaposed paths. Apparatus (16) is also provided for supporting the reel with the reel flanges straddling a portion of the group of paths.

4 Claims, 8 Drawing Figures

COIL REMOVAL APPARATUS

TECHNICAL FIELD

This invention relates to apparatuses for removing coils or convolutions of scrap wire and cable from reels.

BACKGROUND OF THE INVENTION

The most common manner in which scrap wire and cable is accumulated as for storage or recycling is by winding of the wire or cable onto reels. Once loaded with the scrap wire or cable the reels may then be readily transported to a processing plant for disposal, recycling, or other use. It is almost inevitably necessary to remove the coiled scrap from the reel in order to process the wire or cable and to reuse the reel itself. The condition of the scrap wire and cable however is often such that it is frayed and so intertwined on the reel as to be difficult to unload by normal unreeling operations. Even in those cases where unreeling may be readily accomplished, the task ofunreeling is inherently a time and space consuming process. This is a particularly inefficient process where the condition of the scrap or cable once removed is of little concern.

Heretofore, as exemplified by U.S. Pat. No. 2,670,570, which is assigned to the assignee of the present invention, apparatus has been devised for removing scrap wire from spools by cutting the wire while it remains wound upon the spool. This is done by driving a cutter blade in the plane of the center of the spool whereby each convolution of wire on the spool is simultaneously severed. The wire is then free to fall off of the spool as by gravity. In this manner the wire is simultaneously both removed from the spool and cut into numerous segments to facilitate handling.

Although apparatus of the type just described is useable in removing wires of relatively small gauge and strength from spools they are not effective in removing strong, large size wires and cables. This is attributable to the fact that there simply is insufficient force available to drive the cutter simultaneously through numerous convolutions of relatively strong material without damaging the spools.

In addition to the problem just described in supplying sufficient severing power to sever numerous convolutions of relative strong wire and cable directly from reels, other problems also exist in utilizing this method to avoid unreeling. For example, reels of the type adapted to support large cables and wires are themselves extremely heavy and bulky to handle. Typically such reels weigh from 200 to 1,500 pounds in an unloaded condition and from 500 to 12,000 pounds in a fully loaded condition. It thus is difficult to move such reels to a cutter mount or mandrel and to mount and dismount it in an efficient manner. In addition, since reels come in various sizes, to center and sever coils from reels of varying hub widths requires the use of either several cutters of differing sizes or of one cutter with interchangeable blades. These latter cutters must, of course, be recentered each time a replacement is made in order to avoid the cutter blade from either striking one or both of the reel flanges, or in not severing all of the convolutions. If as little as one or two convolutions remain uncut after a cutting operation, removal efficiency may be diminished since those coils must either be recut or unreeled. It is to these problems to which the present invention is primarily addressed.

SUMMARY OF THE INVENTION

In one preferred form of the invention apparatus is provided for removing coils of scrap wire or cable from about a reel having a hub straddled by two flanges. The apparatus comprises an array of juxtaposed cutting blades and means for reciprocally driving each of the cutting blades independently along a different path in a group of mutually juxtaposed paths. The apparatus further comprises means for supporting the reel with the reel flanges straddling at least a portion of the group of paths, and with the reel hub positioned closely adjacent an end of the groups of paths.

DETAILED DESCRIPTION

Figure 8:
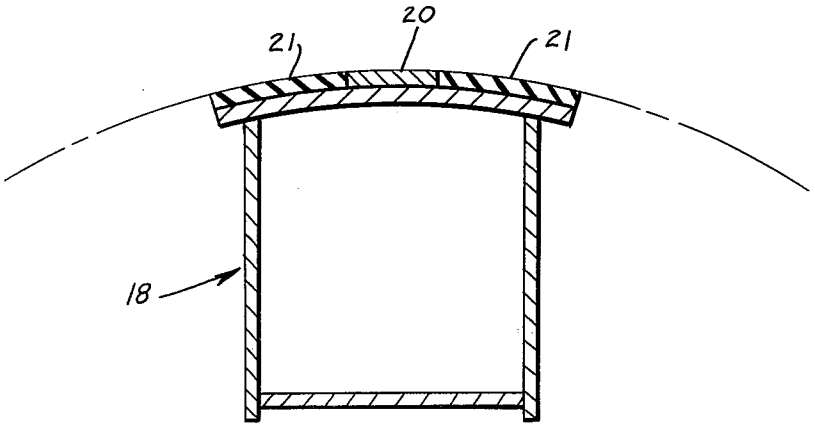
FIG. 8 is a cross-sectional view of the lower arm of the reel support component of the apparatus shown in FIG. 1.

Referring now in more detail to the drawing, there is shown a fork lift truck 10 having an upright mast 12 upon which a carriage 14 is slidably mounted. A frame member 15 is releaseably attached to the movable carriage 14 by unshown hook means from which frame member a generally C-shaped support 16 projects. The C-shaped support 16 has an upper arm 17 and a lower arm 18 that are bridged together by a trunk 19. FIG. 8 depicts a cross-sectional view of the support lower arm 18 which reveals that its upper surface is slightly convex and has a metallic, central rib 20 which is straddled by two rubber support pads 21. These pads in an unloaded condition typically extend above the surface of rib 20 but when loaded are compressed approximately to the configuration illustrated.

Figure 2:
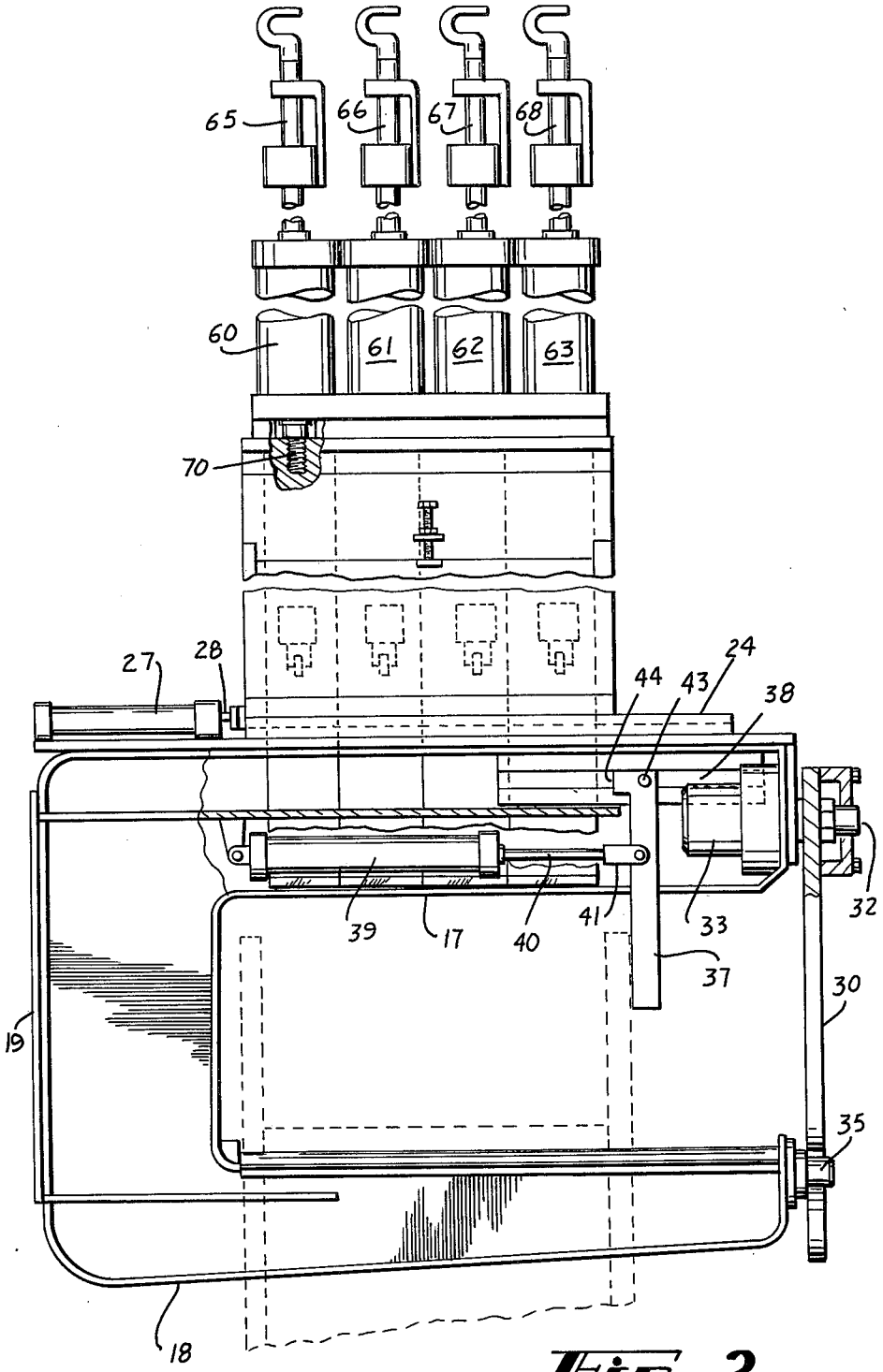
FIG. 2 is an enlarged side elevational view of the apparatus shown in FIG. 1 with a portion of the apparatus broken away to reveal internal components.
Figure 3:
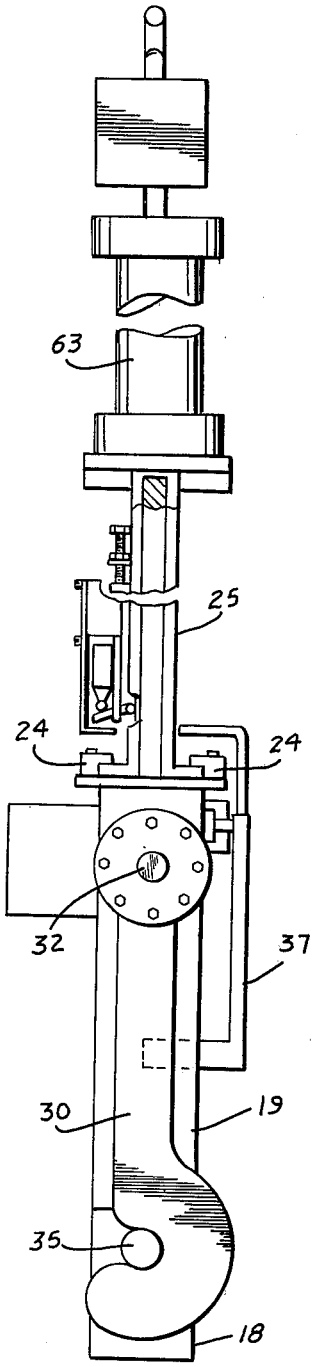
FIG. 3 is an end elevational view of the coil removal apparatus shown in FIGS. 1 and 2.

With continued reference to the drawing, the upper arm 17 of the C-shaped support member is seen to be provided with two guide rails 24 between which an upright cutter housing 25 is slideably guided. A hydraulic cylinder 27 is fixedly mounted atop this support arm with its piston rod 28 secured to the cutter housing. A hook 30 is pivotably mounted to an end of support arm 17 distal the support trunk 19 by means of a rotatable shaft 32 that is driven by a hydraulic rotator 33 into and out of hooking engagement with a support pin 35 that projects from the end of the lower support arm 18 distal trunk 19. A push rod or lever 37 is also mounted to the upper support arm 17 for sliding movement along a guide slot 38 in response to actuations of another hydraulic cylinder 39 having a cylinder rod 40 coupled by a clevis 41 with the push rod. The push rod is pivotably suspended from a pin 43 so that upon striking an end of the guide slot 38 further movement of the piston rod 40 causes the push rod to pivot upwardly in a counterclockwise direction as viewed in FIG. 2. Note that a side 44 of the push rod is positioned to serve as a stop for the cutter housing 25. Thus, the hydraulic cylinder 39 is selected to have more power than that of the hydraulic cylinder 27 whereby actions of hydraulic cylinder 27 in repositioning the cutter housing is insufficient to cause the push rod 37, that is coupled with hydraulic cylinder 39, to give way under impact by the cutter housing.

Figure 5:
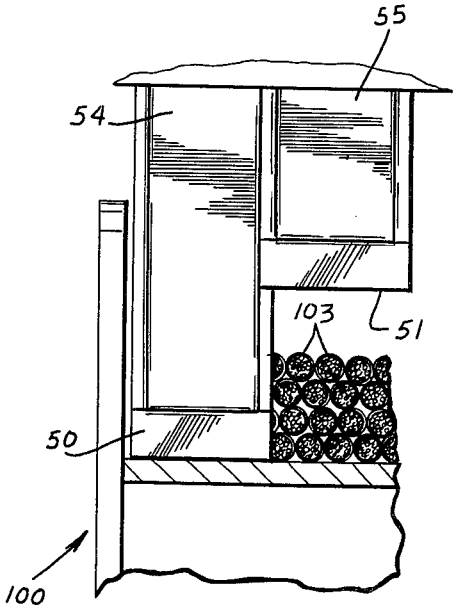
FIG. 5 is a fragmentary view of a portion of the cutting blades array of the apparatus shown in FIG. 1 in the process of cutting coils of scrap cable from a reel.
Figure 7:
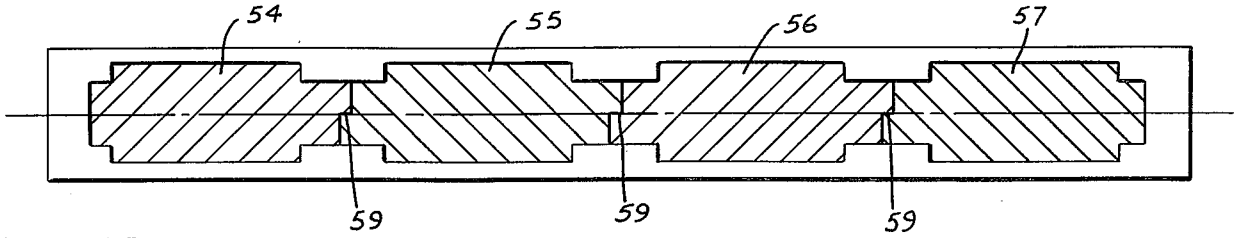
FIG. 7 is a cross-sectional view of the array of cutting blade rams of the apparatus shown in FIG. 1.

The cutter housing 25 is seen to house four blades 50–53 which are respectively mounted to the bottoms of four cutter rams 54–57. As best shown in FIGS. 5 and 7 the four rams and cutting blade assemblies are mounted in mutually parallel succession with adjacent rams and blades being in sliding contact with one another. The rams and cutting blades are seen to have small side portions 59 mutually overlaying one another. As a result the edges of the four blades may form a continuous cutting edge without significant gaps therebetween once vertically aligned. Since these small overlapping side edge portions of the blades have reduced tapered thickness in the area adjacent the blade cutting edge, the taper to one side may be enlarged somewhat in this area for stiffening purposes, if desired.

The rams 54–57 are each respectively mounted to an actuation rod of cylinders 60–63 by means of threaded ends 70 that are carried in vertical orientations atop the cutter housing 25. Hydraulic hammers 65–68 are also respectively mounted atop the piston rods of the cylinders 60–63. Unshown adjustment means are provided for adjusting the positions of the blades relative to one another and to the upper surface of lower arm 18 to insure that their stroke in being driven by the hydraulic cylinders terminates just short of striking the hub of a reel supported on the lower arm. This adjustment means may also be used to reposition the blades after sharpening during periodic maintenance.

Figure 4:
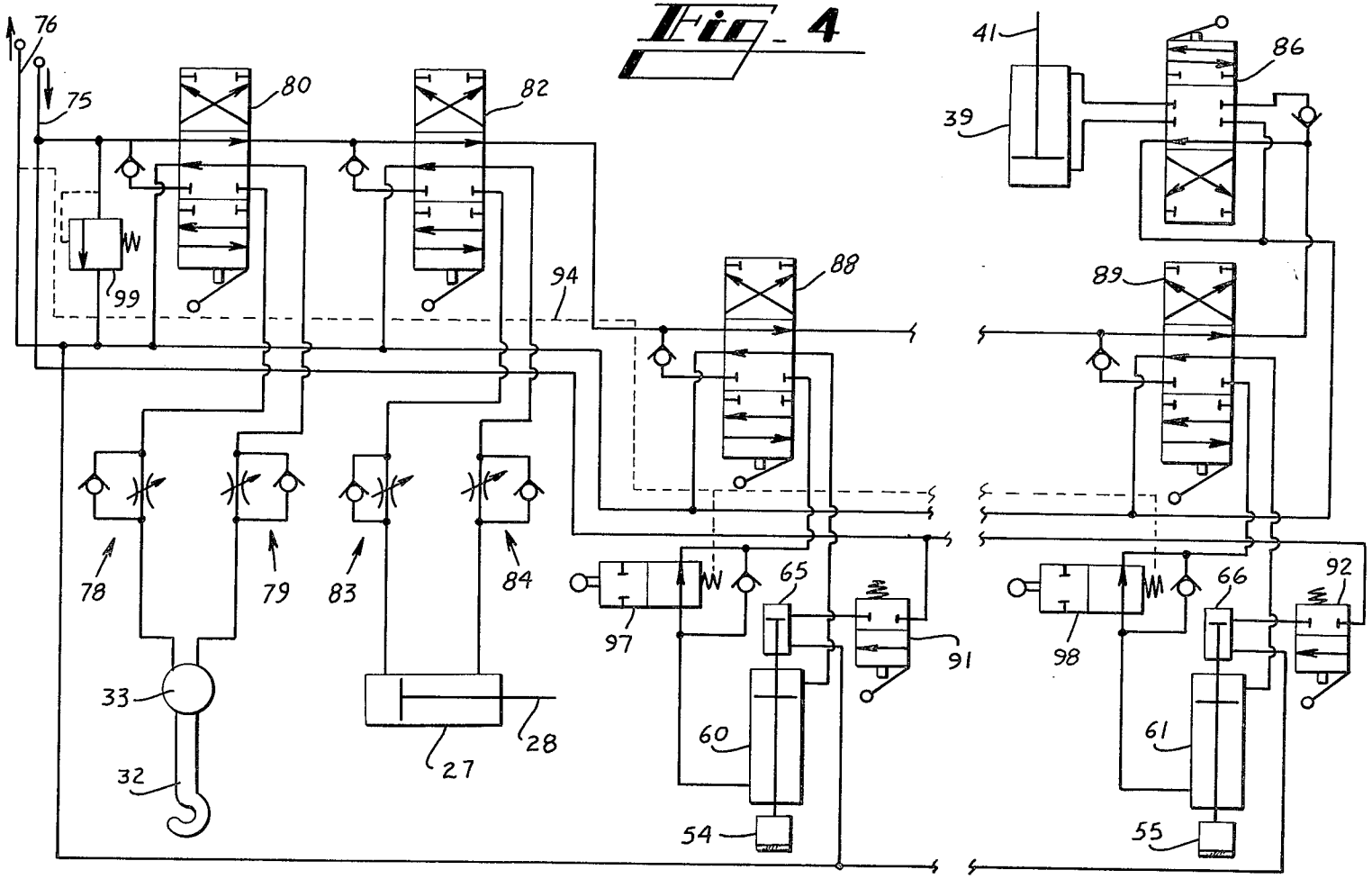
FIG. 4 is a schematic diagram of the hydraulic control and drive system component of the apparatus shown in FIG. 1.

With reference next to FIG. 4 the hydraulic control system for actuating the various cylinders is seen to include an input hydraulic line 75 that communicates with an unshown hydraulic pump, which may be part of the fork lift hydraulic system, and an output line 76 for return of hydraulic fluid to an unshown reservoir through which the fluid is circulated. The hydraulic circuit itself is of conventional design and is seen to include speed controls 78 and 79 for controlling fluid applied to a hydraulic rotator 33 for hook 32 through auxiliary lines that communicate with the lines 75 and 76through a three positional type directional control valve 80. The cylinder 27, used in laterally relocating the cutter housing, is also seen to be serviced with hydraulic lines coupled with another three positionable directional control valve 82 through speed control valves 83 and 84. The reel positioning and stop cylinder 39 is also coupled with a three positionable directional control valve 86.

Each of the four cutter drive cylinders are coupled with the lines 75 and 76. In the schematic diagram only two of these cylinders 60 and 61 are shown for simplicity. They are coupled with the lines 75 and 76 through other three positionable directional control valves 88 and 89, respectively. A hydraulic hammer control valve 91 is in the hydraulic circuit for controlling the hydraulic hammer 65 mounted atop the piston rod of cylinder 60 while another hammer control valve 92 is in the circuit for controlling the hydraulic hammer 66. The other cutter drive cylinders have their hydraulic hammers controlled with the use of unshown hydraulic control valves in the same manner. A suitable valve drain line 94 is provided for the system as shown with the broken line. Deceleration limit valves 97 and 98 are also provided for the cutter drive cylinder 60 and 61 while a pressure relief valve 99 services the entire system.

Figure 1:
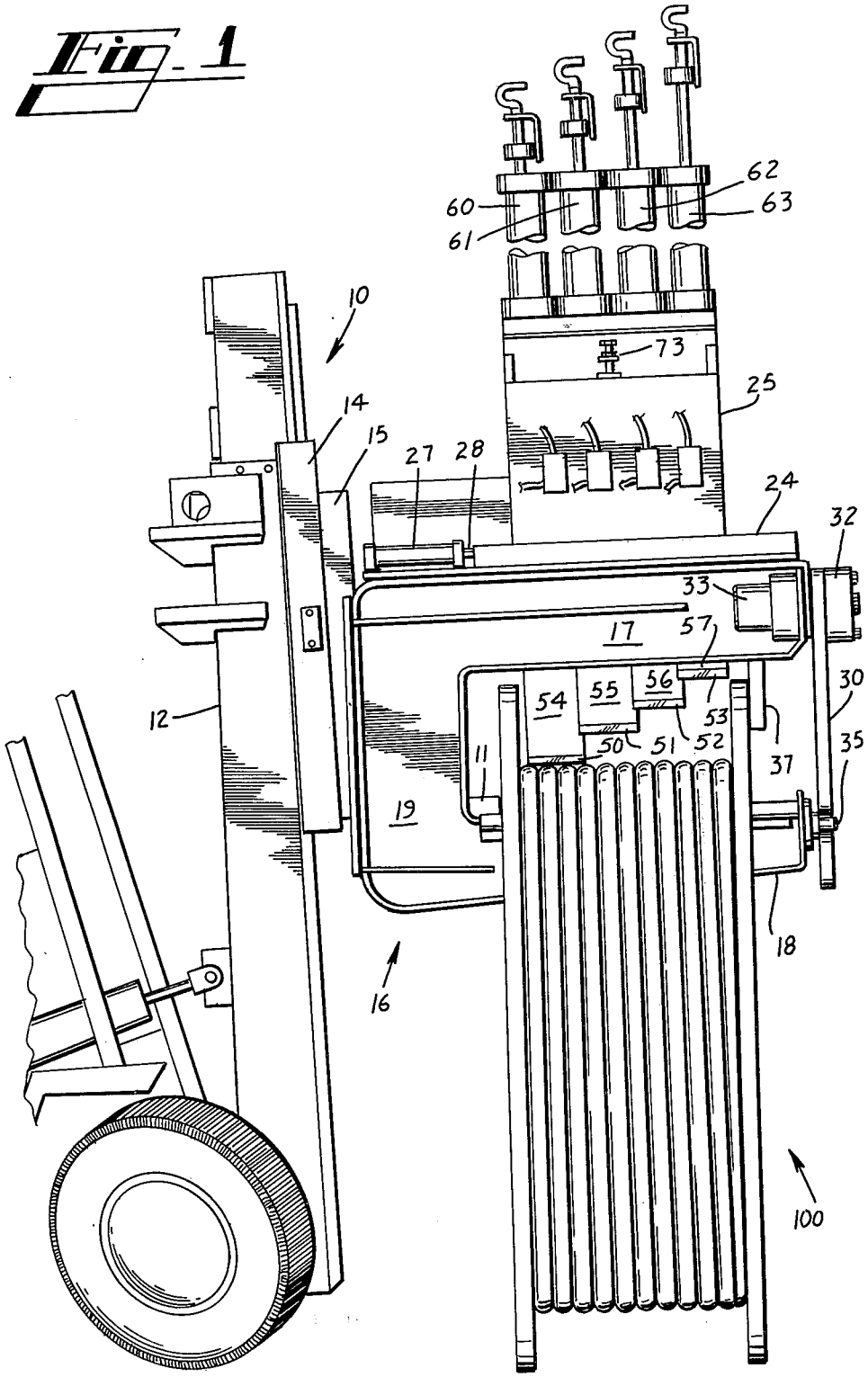
FIG. 1 is a side elevational view of coil removal apparatus embodying principles of the invention shown mounted to a fork lift truck with a reel loaded with scrap cable supported on the apparatus in the process of being cut.

In operation the C-shaped support member 16 is moved on the carriage 14 into a vertical position for the support lower arm 18 to be passed through the hub of a reel 100 shown in FIG. 1 as by forward movement of the fork lift truck. This is done with hook 30 pivoted out of engagement with pin 35 and with the push rod 37 pivoted upwardly to open the space between the support upper and lower arms to receive the reel. Once the reel 100 has been positioned upon this support lower arm, the support is raised thereby lifting the reel off the supporting terrain and the push rod 37 driven to the left as shown in FIG. 1 by actuation of cylinder 39. This causes the push rod to pivot to a vertical orientation and then to push against the flange of the reel 100 causing the reel to be slid atop the lower support into engagement with a stop 11 located at the juncture of the support lower arm 18 and trunk 19. The push rod 37 is held in this position and the hook 30 rotated into hooking engagement with pin 35.

Figure 6:
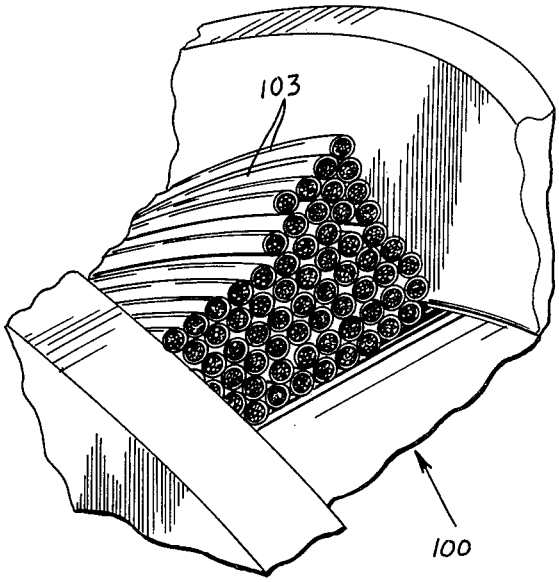
FIG. 6 is a fragmentary view of a reel still partially loaded with coils of cable that have been severed as by the apparatus shown in FIG. 1.

Next, the cutter housing 25 is urged to the left to assure that it abuts an unshown stop which serves to position the cutter rams 54–57 and blades 50–53 above the reel 100 between its two flanges. The blade 50 is then driven downwardly along a vertical path passing just inside of the left reel flange as shown in FIG. 5 and brought to a stop just short of the reel hub causing the blade to sever a group of cable coils on the left hand side of the hub. This, of course, is done by actuation of valve 88 that controls cylinder 60. With blade 50 remaining in its fully extended, downward position a group of coils immediately to the right of those that have just been severed are prevented from slipping laterally but rather are held in position for subsequent cutting. Thus, as the next cutter blade 51 is brought downward by the action of valve 86 and cylinder 61 a clean cut is made to that next group of coils. In descending that blade 51 is also driven downwardly along a path closely paralleling that followed by blade 50 since the two blades and their supporting rams are mounted in sliding contact with one another. Similarly the blades 52 and 53 are driven downwardly sequentially whereupon all of the coils become severed as shown in FIG. 6. If desired the sequence may be rearranged.

If the scrap wire is relatively flexible and of small gauge it will tend to gravitate off of the reel hub once completely severed. However, if the cable or wire is of such a nature as to be relatively strong, it may be necessary to make a second cut radially spaced from the first cut for it to fall free. This may be done by momentarily lowering the reel onto the supporting terrain, rotating the reel 180°, lifting it, and then repeating the cutting operation. Following that the convolutions, having been severed at radially opposite locations, fall easily off of the reel. During the intermediate lowering operation a coil retaining chain may be used to prevent any coils from slipping free of the reel.

Often the reel may be wider than the array of cutting blades. In that case the procedure just described in causing blades 50–53 to be sequentially driven along mutually parallel cutting paths toward the reel hub is followed by a lateral repositioning of the cutter housing by actuation of cylinder 27 with blades 50–53 raised until the cutter housing 25 strikes the side 44 of the push rod 37. This action insures that the array of blades is not positioned accidentally by the operator so as to place any of the blades above the right hand flange of the reel 100. Thus the push rod provides the double function of both locating the reel on arm 18 and of preventing misalignment of the cutter housing. Following this the operator may cause the cutter blade just to the left of any uncut coils to be lowered to hold the remaining coils in place as the blades above them are sequentially operated in completing the cut.

That several cutting blades are employed enables strong cable to be severed that otherwise might not be possible. As this is done the hook 30, in hooking engagement with pin 35, insures that good mechanical support is maintained along the entire C-shaped support and allows a large cutting load to be applied without overstressing the lower arm. In the case of extremely strong cable or wire being wound about the reel, it may be desirable to employ the hydraulic hammers 65–68. For example, should it be found that a single blade will not cut all the way through a group of coils a hammer control valve, such as valve 91 or valve 92, may be actuated causing a hammer to provide a periodic pounding force upon a cylinder rod attached to the ram that drives a blade. This is in addition to the force provided by the hydraulic cylinder. As a result an extreme amount of force is applied insuring that even very heavily gauged cables and wires are severed by the combination of actions here of the operative succession of blade actuations plus the use of the hydraulic hammers.

It should, of course, be understood that the just described embodiment merely illustrates principles of the invention in one preferred form. Many modifications, additions, and deletions may be made thereto without departure from the spirit and scope of the invention as set forth in the following claims.

What is claimed is:

1. Apparatus for removing coils of scrap wire from about a reel having a hub straddled by two flanges and with the apparatus comprising an array of juxtaposed cutting blades mounted in mutually parallel succession with adjacent blades in sliding contact with one another and with adjacent side portions of adjacent blades overlaying one another; means for reciprocally driving each of said cutting blades independently along a different path in a group of mutually juxtaposed paths; and means for supporting the reel with the reel flanges straddling at least a portion of said group of paths and with the reel hub positioned closely adjacent an end of said group of paths.

2. Apparatus for removing coils of scrap wire from about a reel having a hub straddled by two flanges and with the apparatus comprising an array of juxtaposed mutually coplanar cutting blades; means for reciprocally driving each of said cutting blades independently along a different path in a group of mutually juxtaposed paths; means for supporting the reel with the reel flanges straddling at least a portion of said group of paths and with the reel hub positioned closely adjacent an end of said group of paths; means for relocating said array of cutting blades and blade driving means relative to said reel support means whereby the array of cutting blades may be relocated axially over a supported reel; and means for sensing the position of the reel flanges upon said reel support means and for limiting movement by said array relocating means of said array of cutting blades in response to sensed positions of the reel flanges to insure that the reel flanges straddle said group of paths in all positions of said array of cutter blades.

3. Apparatus for removing coils of scrap wire in accordance with claim 2 wherein said reel support means comprises a C-shaped support adapted to be mounted to a fork lift truck and having mutually spaced upper and lower arms projecting laterally from an upright trunk-,and wherein said apparatus further comprises a hook pivotally mounted to said C-shaped support upper arm distal said trunk for movement into and out of holding engagement with said lower arm whereby the hook may be mounted and dismounted from the lower arm and pivotably positioned in holding engagement with the lower arm in mechanically supporting the lower arm during cutting operations.

4. Apparatus for removing coils of scrap wire from about a reel having a hub straddled by two flanges and with the apparatus comprising a support having mutually spaced upper and lower support arms; an array of juxtaposed cutting blades movably supported upon said upper support arm; means for reciprocally driving each of said cutting blades independently along a different path in a group of mutually parallel paths; means for relocating said array of cutting blades upon said upper support arm; and means for positioning a reel supported upon said lower support arm beneath said array of cutting blades, said reel positioning means comprising push rod means movably mounted upon said upper support arm with a portion of said push rod means located within the path of travel of said array of blades to limit movement of the array of blades above a reel hub supported on the support lower arm between the reel flanges.

* * * * *